United States Patent [19]

Stahlecker

[11] Patent Number: 4,787,198

[45] Date of Patent: Nov. 29, 1988

[54] OPEN-END FRICTION SPINNING MACHINE

[75] Inventor: Fritz Stahlecker, Josef-Neidhart-Strasse 18, 7347 Bad Überkingen, Fed. Rep. of Germany

[73] Assignees: Fritz Stahlecker; Hans Stahlecker, both of Fed. Rep. of Germany

[21] Appl. No.: 783,522

[22] Filed: Oct. 3, 1985

[30] Foreign Application Priority Data

Oct. 13, 1984 [DE] Fed. Rep. of Germany ..... 3437573

[51] Int. Cl.[4] ..... D01H 15/02

[52] U.S. Cl. ..... 57/401; 57/263

[58] Field of Search ..... 57/263, 401, 22, 261

[56] References Cited

U.S. PATENT DOCUMENTS 4,483,136 11/1984 Stahlecker et al. ..... 57/401
4,541,234 9/1985 Wassenhoven et al. ..... 57/401 X
4,541,235 9/1985 Raasch ..... 57/401 X
4,561,242 12/1985 Stahlecker ..... 57/401 X
4,571,933 2/1986 Stahlecker ..... 57/401

FOREIGN PATENT DOCUMENTS 0034427 8/1981 European Pat. Off. .

*Primary Examiner*—Donald Watkins
*Attorney, Agent, or Firm*—Barnes & Thornburg

[57] ABSTRACT

An open-end friction spinning machine is provided having a plurality of spinning units arranged next to one another. A suction device assigned to each spinning unit which acts in the area of the yarn formation zone may be selectively switched off such as in the case of a yarn breakage. So that the air throughput balance does not change in the area of the other spinning units when the suction device of a single unit is switched off, devices are provided for maintaining the air throughput relatively constant. Air throughput normally used by the suction devices in the yarn forming area of the spinning unit is diverted, for cleaning and maintenance purposes.

32 Claims, 5 Drawing Sheets

FIG. 1
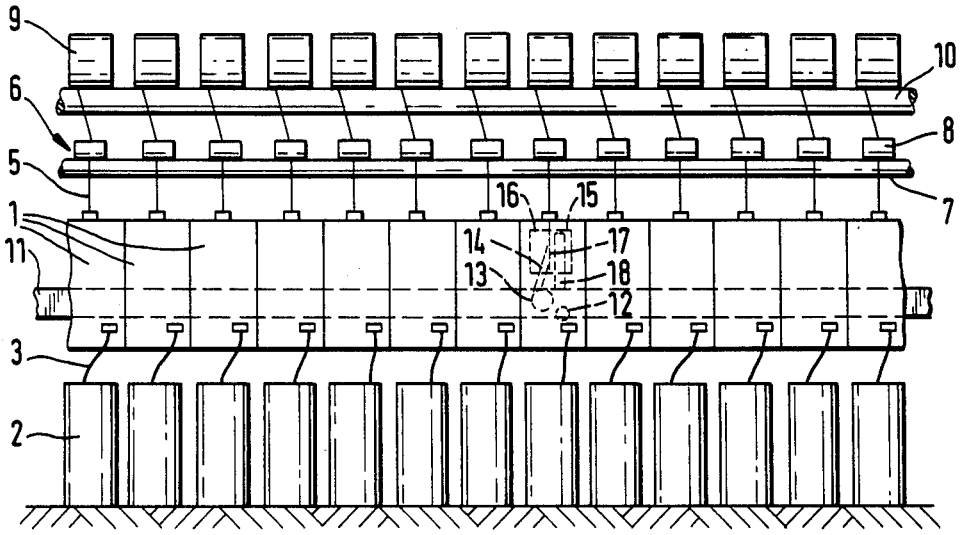
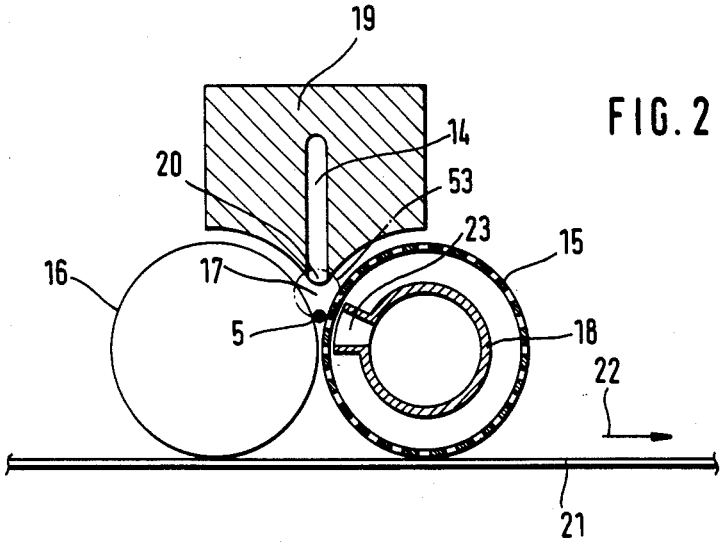
FIG. 2

6
8
7
49
30
665
661
662
663
664
5
671
647
648
666
638
670
668
15
667
20
18
54
619
14
653
669
641
635
636
611
13
655
24
37
657
651
652
674
660
687
658
675
656
688
689
659
672
673
683
682
680
681
685
679
678
684
676
686
677

OPEN-END FRICTION SPINNING MACHINE

BACKGROUND AND SUMMARY OF THE INVENTION

This invention relates to an open-end friction spinning machine having a plurality of spinning units. Each spinning unit has two rollers that are arranged next to one another, are drivable in the same rotational direction and form a wedge-shaped gap used for the formation of yarn. A suction device connected to a vacuum supply system is assigned to the wedge-shaped gap and is used for holding the forming yarn in the wedge-shaped gap.

A device for open-end friction spinning having a single spinning unit is disclosed in EP-OS No. 34 427. A wedge-shaped gap used for the formation of yarn is formed by two rollers that are arranged next to one another and are drivable in the same rotational direction. One of the two rollers has a perforated shell surface and a suction insert arranged inside. The suction insert, with the suction slot, is aimed at the area of the wedge-shaped gap. The suction insert is connected to a vacuum supply system. In the case of a yarn breakage, the feeding of the fiber material to be spun is interrupted by a yarn guard, while all other drives and devices continue to run. In the interior of the suction insert of the perforated roller, a device is arranged by means of which the suction slot can be closed progressively. By means of this device, a yarn end can be sucked into the area of the wedge-shaped gap prior to a piecing process. Subsequently, for the actual piecing, the suction slot is opened again and the fiber feeding means are turned on. A production machine would have to be composed of a plurality of such systems.

One object of the present invention is to provide an open-end friction spinning machine having a plurality of spinning units in such a way that a construction is obtained that is simple.

Another object of the present invention is the provision of an open-end friction spinning machine wherein the individual spinning units may be operated individually, without impairment of the operation of the adjacent spinning units.

These and other objects of the present invention are achieved by a construction wherein the suction devices of the spinning units are connected to a joint vacuum supply system by means of connecting lines, and wherein the spinning units are equipped with means for the blocking of the connecting line arranged in the connecting line between the suction devices and the vacuum supply system. The blocking means for the blocking of the connecting line are activiated by means for monitoring of spun yarn in the case of yarn breakage in especially preferred embodiments of the invention. Other means that are activated by the means for the monitoring in the case of yarn breakage are provided for at least approximately maintaining constant the air throughput in the vacuum supply system.

In order to ensure a construction of an open-end friction spinning machine that is as simple as possible, a joint vacuum supply system is provided to which the suction devices of the individual spinning units are connected. In order to avoid that in the case of a yarn breakage fiber residues that may have remained in the wedge-shaped gap and are no longer withdrawn are twisted together to form a hard yarn bead which may cause damage, it is provided that at the time of a yarn breakage, the suction device of the concerned spinning unit is also turned off. The fiber residues that may still be in the wedge-shaped gap will then no longer be sucked into the wedge-shaped gap.

The effect of the suction devices of the individual spinning units has an important influence on the spinning conditions and thus also on the produced yarn. Accordingly, it is provided at the same time that when a yarn breakage occurs at several spinning units and the corresponding suction devices are therefore, blocked, there will be no increased suction effect due to the increased air throughput at the other spinning units. Therefore, the spinning conditions at these spinning units remain unchanged. This is especially advantageous when an open-end friction spinning machine is started and the individual spinning units are started one after the other. If it were not provided that the air throughput in the vacuum supply system, and thus also in the spinning units already started, is maintained constant, the effects of the suction devices of the already started suction units would vary, resulting in considerable variation in the spun yarn qualities.

In one development of the invention, it is provided that each spinning unit is equipped with an auxiliary suction device. The means for the monitoring during a yarn breakage connects the auxiliary suction device with the vacuum supply system instead of the suction device. This auxiliary suction device is designed for at least approximately the same air throughput as the suction devices. This ensures that when the suction devices of several spinning units are blocked, because of yarn breakage or in the case of a starting of the spinning machine, the same air throughput is ensured at the individual spinning units and thus in the whole vacuum supply system. The overall air balance is thus kept constant so that the air balance at each individual spinning unit is also unchanged.

In a preferred embodiment of the invention, it is provided that each spinning unit is equipped with at least one air inlet opening that is used as the auxiliary suction device and can be connected with the vacuum supply system instead of the suction device. By means of a corresponding dimensioning of the cross section, this type of air inlet opening in a simple way can be adjusted such that through it, the same amount of air is taken in as by means of the suction device with the same supplied vacuum.

In a further development of the invention, it is provided that the air inlet opening connect to a duct whose mouth is aimed at the wedge-shaped gap. Thus the auxiliary suction device performs an additional function, i.e. a cleaning function by means of which the area of the wedge-shaped gap is subjected to suction in the case of a yarn breakage. It is thus possible to remove by suction the residual fibers remaining in the area of the wedge-shaped gap in the case of a yarn breakage which are no longer held in the wedge-shaped gap by the effect of the suction device.

In a further development of the invention, it is provided that the air inlet opening can be connected with a duct, the mouth of which is located in the area of a feeding and opening device. Thus, by means of the auxiliary suction device, another function can be carried out, namely the function of the cleaning of the feeding and opening device. In order to intensify the cleaning of the wedge-shaped gap as well as of the feeding and opening device, it may be provided as a development of the invention that compressed-air nozzles are in each case assigned to the mouth of the corresponding ducts which are opened at the time of a yarn breakage so that the cleaning will then be assisted by the discharged compressed air.

In a further development of the invention, it is provided that the mouth of the duct, as an extension of the wedge-shaped gap, is preferably arranged on the side that faces away from a yarn withdrawal device. Thus, this auxiliary suction device can be assigned another function during the start spinning process because then, by means of this auxiliary suction device, the yarn end that is to be returned to the area of the wedge-shaped gap for the piecing process is taken in by suction . In order to be able to continue to utilize the auxiliary spinning device for the piecing process, it is provided in a further development of the invention that the means for the blocking of the suction device and the means for the connecting of the auxiliary suction device connected at the duct leading out in the proximity of the wedge-shaped gap can be switched to an intermediate position in which the suction device and the auxiliary suction device are connected to the vacuum generating system. Since this operating condition occurs in each case only at one spinning unit, the overall air balance is not disturbed significantly, so that an increased intake by suction is permissible for a short time.

In a further development of the invention, a sliding valve is provided as the means for the blocking and connecting of the suction device and the auxiliary suction device from and with the vacuum supply system, said slide valve being operable by means of an electromagnet controlled by a yarn guard. This results in a simple and effective construction. In an advantageous development, it is provided in this case that the electromagnet is arranged in such a way that it locks the slide that is stressed by means of a spring in the operating position. The electromagnet then does not have to act continuously against the spring but must only be excited in the case of a yarn breakage for the unlocking of the slide. It will then also be advantageous that an actuating element is assigned to the slide which in each case projects out of the spinning unit. By means of this actuating element, the slide can then be actuated during a piecing process by a servicing apparatus that can be applied to the corresponding spinning unit and controls the piecing process.

Other objects, advantages and novel features of the present invention will become apparent from the following detailed description of the invention when considered in conjunction with the accompanying drawings.

BRIEF DESCRIPTION OF THE DRAWINGS

FIG. 1 is a front view of a part of an open-end friction spinning machine having a plurality of spinning units that are arranged next to one another in accordance with a preferred embodiment of the present invention;

FIG. 2 is an enlarged section through a spinning unit in the area of two rollers that are arranged next to one another and form a wedge-shaped gap in accordance with a preferred embodiment of the present invention;

DETAILED DESCRIPTION OF THE DRAWINGS

Figure 3:
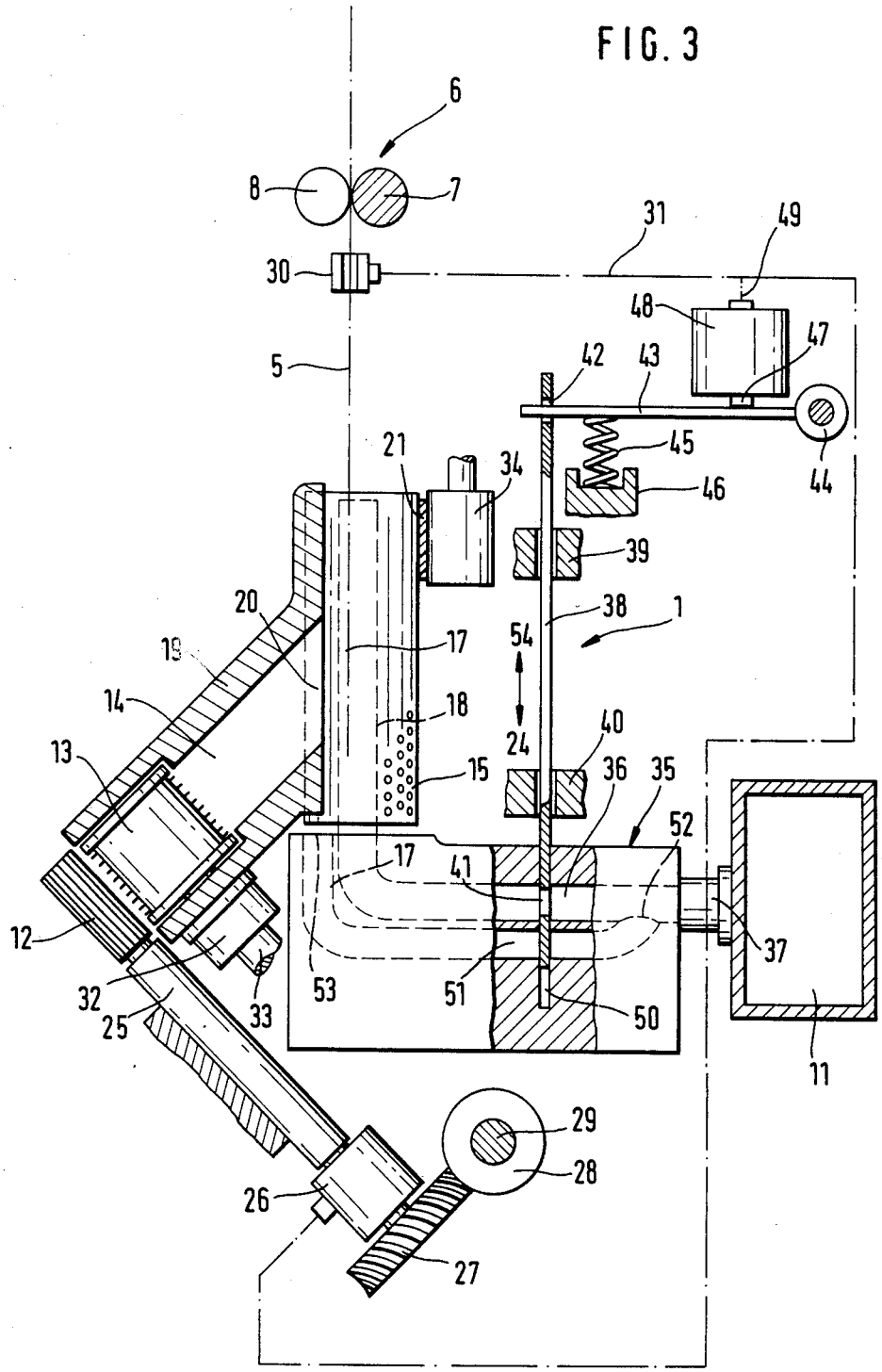
FIG. 3 is a part sectional lateral schematic view of an individual spinning unit constructed in accordance with a preferred embodiment of the present invention.

The open-end friction spinning machine according to FIG. 1 has a plurality of spinning units 1 that are arranged next to one another and are identical to one another. Preferably one row of spinning units 1 is provided on each side of the machine. A can 2 having a sliver 3 is assigned to each spinning unit 1. The sliver 3 is introduced into the spinning unit 1 and is spun into yarn 5. The spun yarn 5, by means of a withdrawal device 6, is withdrawn from each spinning unit 1. The withdrawal devices 6 each include one individual pressure roller 8 for each spinning unit 1 which interacts with a driven cylinder 7 running along in the longitudinal direction of the machine. Subsequently, the yarn is wound onto a windup spool 9 which rests on a roller 10 running along in the longitudinal direction of the machine and is driven by it.

Each spinning unit 1 has a feeding roller 12 which, in a manner that is not shown in detail interacts with a feeding table and pulls in the sliver 3. The sliver 3 is offered to a more rapidly turning opening roller 13 which opens up the sliver 3 into individual fibers. Via a fiber feeding duct 14, the fibers are fed to a wedge-shaped gap 17 which is formed by two rollers 15 and 16 that are arranged adjacent to one another and in parallel to one another and are drivable in the same rotational direction. At least one of the two rollers, roller 15 in the case of the embodiment according to FIG. 1, is connected to a vacuum duct 11 running through in the longitudinal direction of the machine via a suction pipe 18. The vacuum duct 11 in each case extends over one side of the machine up to the headstock of the machine and there is equipped with a suction fan.

The fiber feeding duct 14 (FIG. 2) is part of a housing 19 which at least partially covers the area of the wedge-shaped gap 17. The fiber feeding duct 14, with its mouth 20, extends in a slot-shaped manner in the longitudinal direction of the wedge-shaped gap 17 and is at a relatively close distance to it. The two rollers are drivable in the same rotational direction. In the case of this embodiment, the drive takes place by means of a tangential belt 21 which moves in the direction of the Arrow 22 in the longitudinal direction of the machine and which runs against the shell or cover surfaces of the two rollers 15 and 16. The roller 15 rotating into the fiber-carrying wedge-shaped gap 17 has a perforated shell surface. A pipe-shaped suction insert 18 is located on its interior. This suction insert 18 is equipped with a suction slot 23 that is aimed in the radial direction at the area of the wedge-shaped gap 17. The suction insert 18 is connected to the vacuum duct 11. The roller 16 rotating out of the wedge-shaped gap 17 may, corresponding to the roller 15, also be constructed as a suction roller, i.e., be equipped with a suction insert 18 and a suction slot 23 pointing in the direction of the wedge-shaped gap 16 in accordance with certain contemplated embodiments of the invention. However, in the case of the embodiment shown, it is provided that this roller 16 is construed as a so-called solid roller, i.e., it has a closed shell surface. The rollers 15 and 16, in a manner that is not shown in detail, are disposed directly on pipes by means of roller bearings, i.e., on the suction insert 18 or a similar pipe.

On the basis of the suction intake via the suction insert 18 and the suction slot 23, an air current is created in the area of the wedge-shaped gap 17 that is directed toward the interior of the roller 15. This air current is used for holding the forming yarn 5 in the wedge-shaped gap 16. The current also has the purpose of promoting the fiber transport in the fiber feeding duct 14.

As shown in FIG. 3, the feeding and opening device containing the feeding roller 12 and the opening roller 13 is arranged below the rollers 15 and 16 and staggered toward the operating side, i.e., in the direction of the side of the fiber-carrying wedge-shaped gap 17. A shaft driving the feeding roller 12 is disposed within a pipe 25 which, in a manner that is not shown in detail, is held stationary at the machine frame. At the end facing away from the feeding roller 12, the shaft projecting from the pipe 25, via an electromagnetic coupling 26 is connected with a toothed wheel 27. The toothed wheel 27 mates with a toothed wheel 28 which in a rotationally stable manner is arranged on a driven shaft 29. The shaft 29 extends in the longitudinal direction of the machine and has a corresponding toothed wheel 28 in the area of each spinning unit 1. The electromagnetic coupling 26, via an electric line 31, is connected to a yarn guard 30 arranged between the rollers 15 and 16 and the withdrawal device 6. Preferably, a non-contact yarn guard 30 is provided which responds to a breakage of the yarn 5. In the case of a breakage of the yarn 5, the yarn guard 30 controls the electromagnetic coupling 26 in such a way that it is opened. As a result, while the shaft 29 continues to run, the feeding roller 12 is stopped so that the feeding of the sliver 3 is interrupted.

A bearing housing 32 of the opening roller 13 is arranged in the housing 19. The shank 33 of the opening roller 13 projects from this bearing housing 32, this shank 33, in a manner that is not shown in detail, is driven by a tangential belt running through in the longitudinal direction of the machine, and driving all opening rollers of one side of the machine. The housing 19 is advantageously divided so that at least the part containing the mouth 20 of the fiber feeding duct 14 can be moved away from the area of the wedge-shaped gap 17.

As also shown in FIG. 3, the tangential belt 21 driving the two rollers 15 and 16 in the area of each spinning unit 1, by means of a billy-roller 34 is tighetned in the area of the spinning unit 1.

In the connecting pipe (FIG. 3) a valve 35 is arranged at each spinning unit 1 between the suction insert 18 and the vacuum duct 11. The housing of the valve 35 contains a duct 36 that is connected with the suction insert 18. The duct 35, by means of a transition piece 36 is connected to the vacuum duct 11. The valve 35 is developed as a slide valve 38 that can be slid in slide bearings 39 and 40 transversely to the duct 36 and that is connected with a passage bore 41 that corresponds in cross-section) to the duct 36. This passage bore 41, in the shown operating condition, opens up the duct 36 so that the suction insert 18 is connected to the suction duct 36.

The valve slide 38, at its free end, is equipped with a recess 42 into which an operating lever 43 engages. This lever is pivoted around a stationary shaft 44 extending transversely to the sliding direction of the valve slide 38. The operating lever 43, by means of a pressure spring 45 whch supports itself at a stationary support 46, is pressed against a stop. The stop is the tappet 47 of an electromagnet 48 which by means of an electric line 49 is connected to the yarn guard 30. In the case of a yarn breakage, the yarn guard 30 simultaneously controls the electromagnetic coupling 26 and the electromagnetic piston 48. Therefore, on the one hand, the feeding of the sliver is interrupted and, on the other hand, the valve slide 38 is shifted in the direction of the Arrow 24 so that the suction insert 18 is separated from the vacuum duct 11.

The valve 35 contains another duct 51 which, via an opening 52 in front of the valve slide 38, is connected with the duct 36 and thus with the vacuum duct 11. The duct 51, via a mouth 53, leads out into the open. During the closing of the duct 36, the valve slide 38 is pushed so far into the valve housing that has a corresponding guide 50 that the passage bore 41 arrives in the area of the duct 51. Thus, practically simultaneously with the blocking of the suction insert 18, the duct 51 is connected with the vacuum duct 11. The duct 51, by means of the selection of its cross-section and its length, in regard to its flow resistance, is designed in such a way that by means of it, with the same applied vacuum, the same amount of air is taken in by suction.

As also shown in FIG. 3, the mouth 53 of the duct 51 is an extension of the wedge-shaped gap 17, namely on the side of the rollers 15 and 16 that faces away from the yarn withdrawal device 6. As a result it is achieved that fibers that may be located in the area of the wedge-shaped gap after a yarn breakage are removed by suction via the duct 51. In addition, an end of a yarn for a piecing process can be returned by suction via this duct 51 into the area of the wedge-shaped gap 17.

In the description of the embodiments explained below the reference numbers are used corresponding to similiar reference numbers for corresponding components. As far as changed components with a corresponding function are concerned, a reference number is placed in front corresponding to the number of the drawing figure.

Figure 4:
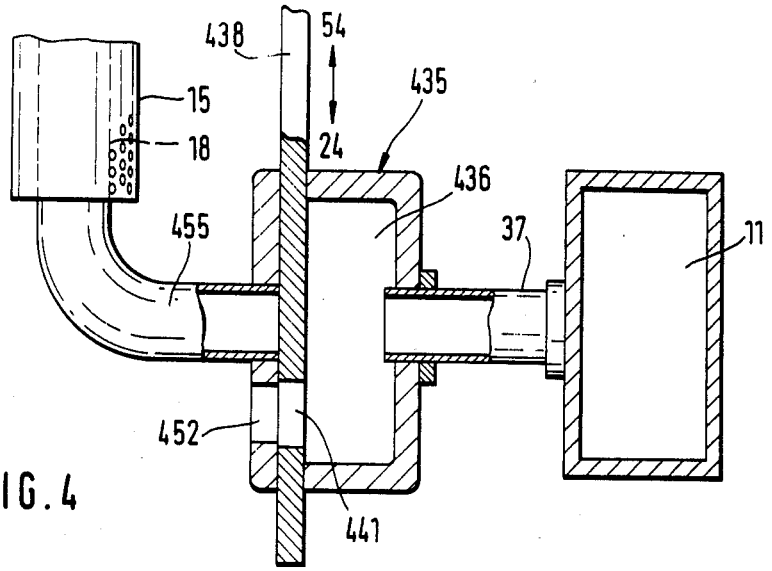
FIG. 4 is part sectional schematic view showing a detail of a spinning unit having a construction that is modified with respect to FIG. 3, in accordance with another preferred embodiment of the present invention.

In the case of the embodiment according to FIG. 4, the suction insert 18 is connected with a valve 435 by means of a bent pipe 455. The valve 435 itself is connected with the vacuum duct 11 via a transition piece 37. The valve 435 is equipped with an inlet air opening 452 which is located below the opening of the pipe 455. The valve 435 contains a valve slide 438 which is provided with an opening 441 which is applied either to the opening of the pipe 455 or to the inlet air opening 452. In the case of the shown situation, the valve slide 438 which is provided with an opening 441 which is applied either to the opening of the pipe 455 or to the inlet air opening 452. In the case of the shown situation, the valve slide 438 is in a position after a yarn breakage, i.e., it was shifted in such a way that it blocks the connection to the suction insert 18 and matches the opening 441 onto the inlet air opening 452. The inlet air opening 452 is dimensioned in such a way that in the case of the same applied vacuum by means of it the same amount of air is taken in by suction as via the suction insert 18 when the opening 441 is in the area of the pipe 455.

Figure 5:
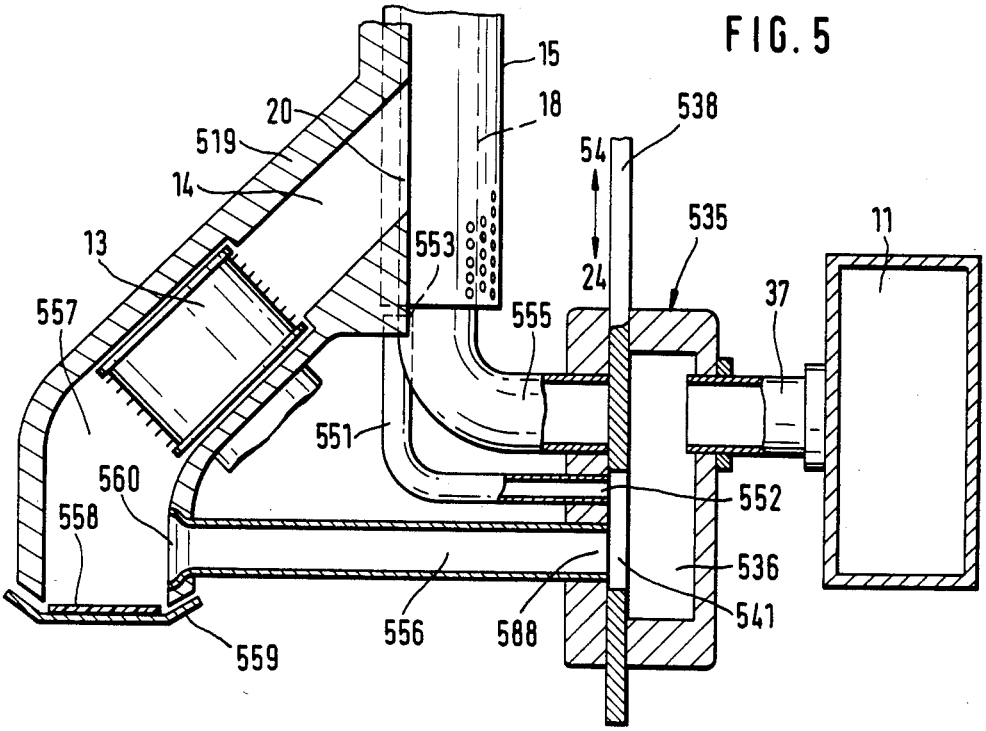
FIG. 5 is a sectional view similar to FIG. 3, showing through another preferred embodiment of the invention with an additional cleaning possibility for the feeding and opening device.

In the case of the embodiment according to FIG. 5, a pipe 555 leading to the suction insert 18 is connected to the valve 535 which by means of a transition piece 37 is connected to the vacuum duct 11. Two openings 552 and 588 are located below the pipe 555. The opening 552 leads to a pipe 551, the mouth 553 of which is an extension of the wedge-shaped gap. The opening 588, via pipe 556, is connected with the housing 519 below the opening roller 13. In this area, the housing 519 is equipped with a dirt elimination opening 557 via which impurities are eliminated from the fiber material which can be carried away by a conveyer belt 558 running through in the longitudinal direction of the machine. The belt is guided in a trough-type guide 559 extending in the longitudinal direction of the machine. The pipe 556 has a mouth 560 located in proximity to the conveyer belt 558. In the shown position after the yarn breakage, the valve slide 538 was shifted in the direction of the Arrow 24 in such a way that the connection of the vacuum duct 11 to the suction insert 18 is closed. The connections to the pipe 551 and the pipe 556 are opened up. A cleaning of the wedge-shaped gap takes place on the one hand, and on the other hand, a cleaning in the area of the elimination opening 557 also take place. In addition, the pipe 551 may be used for the return by suction of a yarn end for the piecing process. Also in the case of this embodiment, the cross-sections and the lengths of the pipes 551 and 556 are designed in such a way that, in the case of the same applied vacuum, at least approximately the same quantity of air is taken in by suction as is taken in by suction corresponding to the position of the valve slide 538 (slid back upwards in the direction of the Arrow 54) via the suction insert 18.

Figure 6:
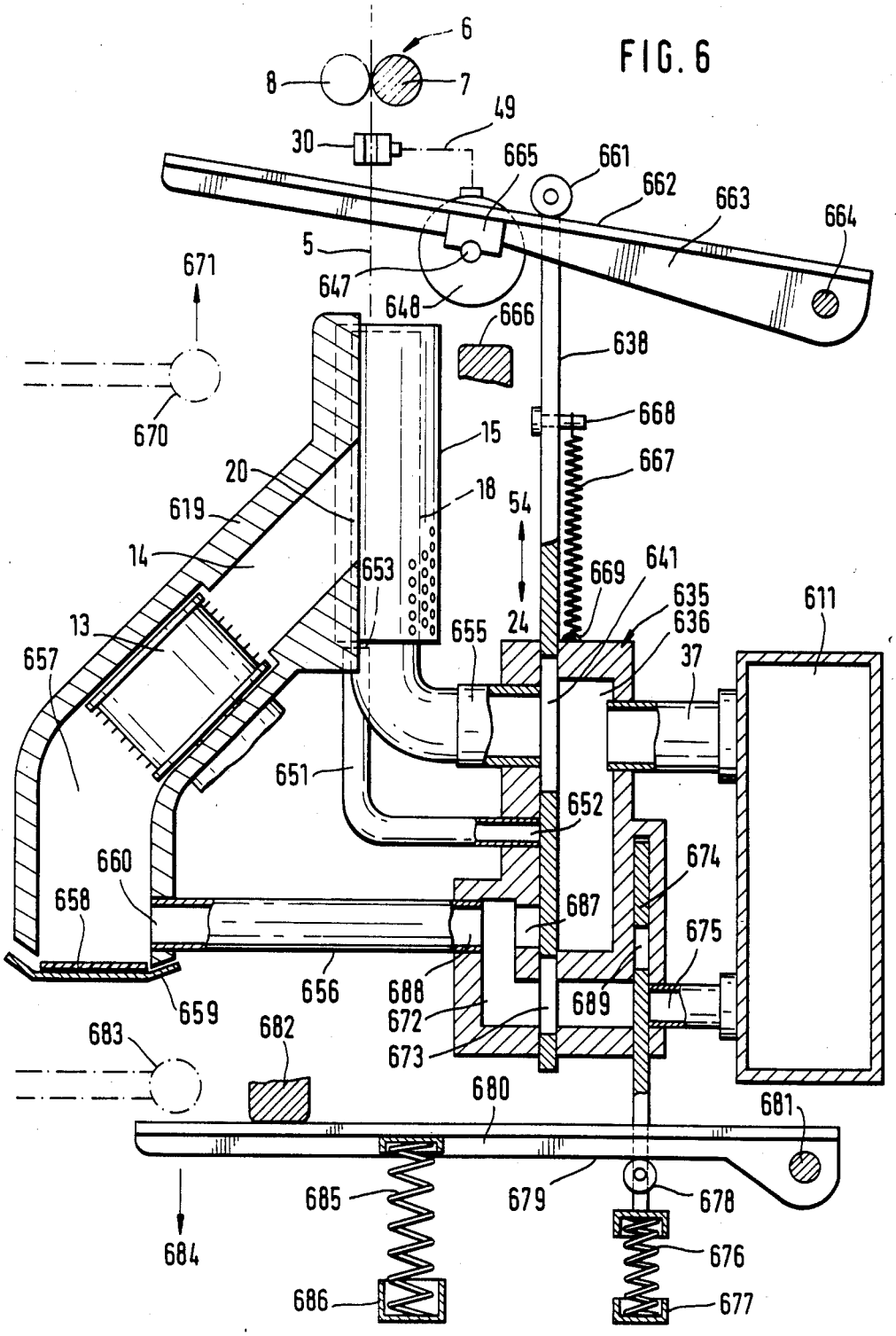
FIG. 6 is a part sectional schematic view through another embodiment of a spinning unit constructed according to the invention, having a cleaning possibility for the feeding and opening device which can be operated independently.

Also in the case of the embodiment according to FIG. 6, two pipes 651 and 656 are connected to the valve 635 in addition to the pipe 655 leading to the suction insert 18. Of these, the pipe 651 with its mouth 653 as an extension of the wedge-shaped gap 17 is arranged on the side of the rollers 15 and 16 that faces away from the yarn withdrawal device. The other pipe 656 with its mouth 660 is located in the area of the dirt elimination opening 657. The yarn guard 30 via a line 49 is connected to an electromagnet 648 having a bolt 647 projecting out of it. The bolt 647 is located in the swivel area of an operating level 663 that can be pivoted around a stationary shaft 664 extending transversely to the shifting direction (24, 54). The operating lever 663 is equipped with a thrust piece 665 that is assigned to the bolt 647. A pully 661 mounted at the valve slide 638 rests on the top side of the operating lever 663 developed as the guiding surface 662. At the valve slide 638, a tension spring 667 is coupled to a bolt 668, the other end of which is coupled in a holder 669 to the valve 635.

In the case of a yarn breakage, the electromagnet 648 is excited so that the bolt 647 is pulled back under the thrust piece 665. Thus, the operating lever 663 is no longer locked so that, together with the valve slide 638 it is moved downward by the spring 667 to a stop 666. The stop 666 is preferably developed to be flexible and adjustable. The valve slide 638 provided with an opening 641 in this case moves in such a way that this opening 641 is moved from the area of the pipe 655 to the area of the openings 652 and 687. The connections between the vacuum duct 611 and the suction insert 18 is interrupted and the connection to the pipes 651 and 656 is opened. That opening 641 in this case is dimensioned in such a way that it can at the same time open up the connection to the ducts 655 and 651, as will be explained later by means with reference FIG. 7D.

The operating lever 663 is extended in the direction of the operating side of the spinning unit 1 so that it is accessible to an adjusting lever 670 of the movable servicing apparatus which can be applied in the direction of the Arrow 671 to this operating lever 663. By means of the adjusting lever 670, the connection between the suction insert and the vacuum duct 611 is reestablished during the piecing process. In addition, in this case, the operating lever 663 is brought into the position in which the bolt 647 of the electromagnet 648 which is loaded by a spring, again engages in its locking position under the thrust piece 665.

The valve 635 is equipped with another duct 672 which, by means of a transition piece 675, is connected to the vacuum duct 611 and to the opening 688 of the pipe 656. A second valve slide 674 is arranged in this connecting duct 672, said second valve slide 674 being provided with an opening 689 which can be made to coincide with the duct 672. The valve slide 674 is loaded by a pressure spring 676 supported at a holder 677. This spring presses a pulley 678 from below against a contact surface 679 of a second operating lever 680. This operating lever 680 is pivotable around a stationary shaft 681 extending transversely to the shifting direction of the valve slide 674. In addition, the operating lever 680 is loaded by a pressure spring 685 which supports itself at a holder 686. This pressure spring 685 presses the lever 680 in closing direction of the valve slide 674 against a stationary stop 682. An adjusting lever 683 of a movable servicing apparatus is assigned to the operating lever 680. By means of this adjusting lever 683, the operating lever 680 can be swivelled in the direction of the Arrow 684. By means of the swivelling of the operating lever 680, the opening 689 of the valve slide 674 can be made to coincide with the duct 672, so that the feeding and opening device is connected with the vacuum duct 611 for cleaning. This connecting takes place during the normal spinning operation exclusively for the purpose of cleaning. The valve slide 638 in this case is constructed in such a way that in the area of the duct 672, it has a passage opening 673 which opens the duct 672 in the shown operating position of the valve slide 638 so that by means of the operation of the operating lever 680, a cleaning in the area of the fiber elimination opening 657 can be carried out. By the shifting of the valve slide 638, the duct 672 is blocked, so that during this inoperative condition, an additional connection of the duct 672 with the vacuum duct 611 is not possible.

Figure 7A:
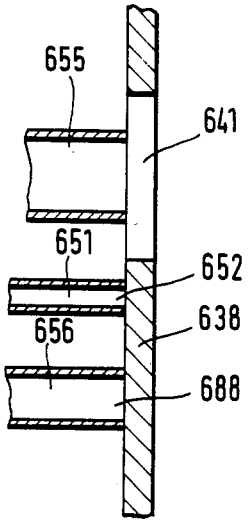
FIGS. 7A, 7B, 7C, 7D depict different positions of a valve slide of the embodiment according to FIG. 6 by means of which the suction device and the auxiliary suction device can each be selectively connected with a joint vacuum source for all spinning units of one side of the machine.
Figure 7B:
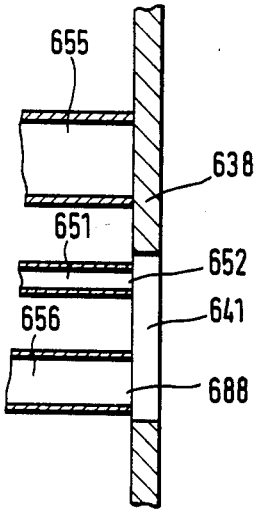
Figure 7C:
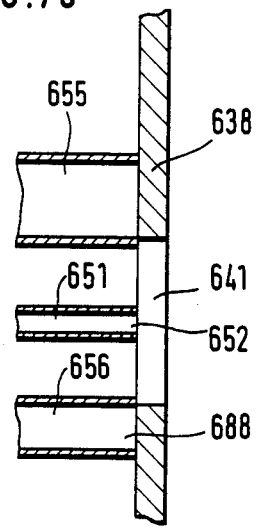

FIGS. 7A to 7D shows the possible operating positions of the slide 638 of FIG. 6. FIG. 7A shows the operating position in which the passage opening 641 of the valve slide 638 is located in the area of the pipe 655 leading to the suction insert 18, while the openings 652 and 688 are closed. In FIG. 7B, the position after a yarn breakage is shown in which the valve slide 638 controlled by the yarn guard 30 was automatically brought into the position in which the connection to the suction insert 18 is blocked and that to the pipes 651 and 656 is opened up. This is the position until the time of a renewed piecing operation.

During the piecing (FIG. 7C), the operating lever 663, by means of the adjusting lever 670, is lifted into an indicated position in which the opening 641 at first only opens up the inlet air opening 652 of the pipe 651 which with its mouth 653 is an extension of the wedge-shaped gap 17. As a result, it is possible, by means of a relatively high suction pull, to return a yarn end by suction for a piecing process. Since this condition in each case occurs only at one spinning unit and only for a short time, it can be accepted that the air quantity deviates slightly with respect to the remaining condition.

Figure 7D:
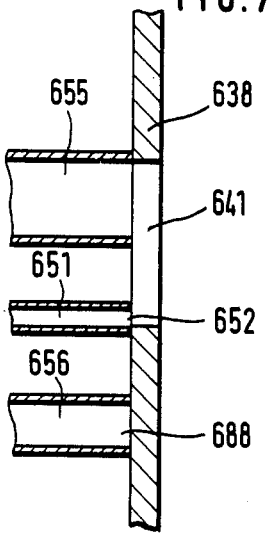

In FIG. 7D, another intermediate position of the valve slide 638 is achieved during the piecing in which it opens up at the same time the inlet air opening 652 of the pipe 651 and the opening of the pipe 655 and thus the connection to the suction insert 18. It is thus possible to already generate a vacuum in the wedge-shaped gap 17 by means of the suction device and at the same time also hold a yarn end in the area of the mouth 653 of the pipe 651. This intermediate condition also only takes up a relatively short amount of time and is in addition carried out only at one single spinning unit. Therefore, this does not result in a significant interference with the air balance in the area of the opening spinning units.

After the end of the piece process, the operating lever 663, by means of the adjusting lever 670 is lifted into its operating position in which the bolt 647 of the electromagnet 648 again engages downward under the thrust piece 665 of the operating lever so that the operating lever 663 is again locked in its operating position.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

We claim:

1. An open-end friction spinning apparatus having a plurality of spinning units, each said spinning unit having drivable friction surface means defining a yarn formation zone, and suction device means for holding a forming yarn in said yarn formation zone, each said suction device means being connected to a joint vacuum supply system by connecting line means, comprising:

blocking means for blocking the connecting line means, throughput control means for maintaining a substantially constant air throughput in said joint vacuum supply system when said blocking means are engaged, said throughput control means comprising auxiliary suction device means at the spinning units which are selectively connectable with the vacuum supply system instead of said suction device means when the connecting line means are blocked for a respective spinning unit, said auxiliary suction device means including means for applying a load on the joint vacuum supply system which is substantially equivalent to the load applied by the suction device at the respective spinning unit, and yarn breakage monitoring means for monitoring yarn breakages and controlling said blocking means and said throughput control means in response to yarn breakage conditions at respective spinning units.

2. An open-end friction spinning machine according to claim 1, wherein said drivable friction surface means comprises a pair of adjacently arranged friction rollers drivable in the same rotational direction, and said yarn formation zone comprises a wedge-shaped gap formed between the friction rollers.

3. An apparatus according to claim 1, comprising yarn breakage monitoring means, said blocking means and said throughput control means being operably responsive to said yarn breakage monitoring means.

4. An apparatus according to claim 1, wherein said throughput control means comprises auxiliary suction device means, said auxiliary suction device means being selectively connectable with said joint vacuum supply system, said auxiliary suction device means being capable of maintaining substantially the same air throughput as said suction device means.

5. An apparatus according to claim 4, comprising yarn breakage monitoring means for monitoring yarn breakage, said auxiliary suction device means being selectively connectable with said vacuum supply system in response to said yarn breakage monitoring means.

6. An apparatus according to claim 1, wherein said auxiliary suction device means comprises at least one inlet air opening means.

7. An apparatus according to claim 6, comprising duct means connected to said inlet air opening means, said duct means being aimed at said yarn formation zone.

8. An apparatus according to claim 7, wherein said yarn formation zone comprises a wedge-shaped gap formed between a pair of adjacently arranged friction rollers rotatable in the same rotational direction.

9. An apparatus according to claim 7, wherein said duct means has a mouth, said mouth being aimed at said yarn formation zone.

10. An apparatus according to claim 9, comprising yarn withdrawal means for withdrawing yarn from said yarn formation zone, said yarn withdrawal means being arranged on one side of said drivable friction surface means, said mouth being arranged on a side of said drivable friction surface means opposite said yarn withdrawal means.

11. An apparatus according to claim 6, including opening device means for opening up a sliver, and duct means connectable with said inlet air opening means, said duct means being engageable with said feeding and opening device means.

12. An apparatus according to claim 11, wherein said duct means has a mouth, said mouth being located in the area of said feeding and opening device means.

13. An apparatus according to claim 11, comprising independently operable blocking element means, said independently operable blocking element means including means for selectively blocking said duct means.

14. An apparatus according to claim 4, including connecting means for connecting said auxiliary suction device means with said vacuum supply system, said blocking means and said connecting means being capable of being disposed in a position whereby both said suction device means and said auxiliary suction device means are in communication with said vacuum supply system at the same time.

15. An apparatus according to claim 14, comprising single blocking-connecting means, said single blocking-connecting means including both said blocking means and said connecting means.

16. An apparatus according to claim 15, wherein said single blocking-connecting means comprises slide valve means.

17. An apparatus according to claim 16, comprising electromagnet control means, said slide valve means being engageable by said electromagnet control means, said electromagnetic control means being responsive to yarn breakage monitoring means.

18. An apparatus according to claim 17, wherein said electromagnet control means includes lock means for locking said slide valve means in a position whereby said suction device means is unblocked.

19. An apparatus according to claim 18, wherein said slide valve means is spring biased in a direction whereby said suction device mean is blocked.

20. An apparatus according to claim 17, comprising actuating element means engageable with the said slide valve means, said actuating element means being capable of reversibly moving said slide valve means into a position whereby said suction device means is unblocked.

21. An apparatus according to claim 20, wherein said actuating element means projects out of said spinning unit for controlling said slide valve means from outside said spinning unit.

22. An open-end friction spinning apparatus having a plurality of spinning units, each said spinning unit having drivable friction surface means defining a yarn formation zone, and suction device means for holding a forming yarn in said yarn formation zone, each said suction device means being connected to a joint vacuum supply system by connecting line means, comprising:

blocking means for blocking the connecting line means;

throughput control means for maintaining a substantially constant air throughput in said joint vacuum supply system when said blocking means are engaged; wherein said throughput control means comprises auxiliary suction device means, said auxiliary suction device means being selectively connectable with said joint vacuum supply system, said auxiliary suction device means being capable of maintaining substantially the same air throughput as said suction device means;

wherein said auxiliary suction device means comprises at least one inlet air opening means; and further including opening device means for opening up a sliver, and duct means connectable with said inlet air opening means, said duct means being engageable with said feeding and opening device means.

23. Apparatus according to claim 22, wherein said duct means has a mouth, said mouth being located in the area of said feeding and opening device means.

24. Apparatus according to claim 22, comprising independently operable blocking element means, said independently operable blocking element means including means for selectively blocking said duct means.

25. An open-end friction spinning apparatus having a plurality of spinning units, each said spinning unit having drivable friction surface means defining a yarn formation zone, and suction device means for holding a forming yarn in said yarn formation zone, each said suction device means being connected to a joint vacuum supply system by connecting line means, comprising:

blocking means for blocking the connecting line means; and throughput control means for maintaining a substantially constant air throughput in said joint vacuum supply system when said blocking means are engaged; wherein said throughput control means comprises auxiliary suction device means, said auxiliary suction device means being selectively connectable with said joint vacuum supply system, said auxiliary suction device means being capable of maintaining substantially the same air throughput as said suction device means;

further including connecting means for connecting said auxiliary suction device means with said vacuum supply system, said blocking means and said connecting means being capable of being disposed in a position whereby both said suction device means and said auxiliary suction device means are in communication with said vacuum supply system at the same time.

26. Apparatus according to claim 25, comprising single blocking-connecting means, said single blocking-connecting means including both said blocking means and said connecting means.

27. Apparatus according to claim 26, wherein said single blocking-connecting means comprises slide valve means.

28. Apparatus according to claim 26, comprising electromagnet control means, said slide valve means being engageable by said electromagnet control means, said electromagnet control means being responsive to yarn breakage monitoring means.

29. Apparatus according to claim 28, wherein said electromagnet control means includes lock means for locking said slide valve means in a position whereby said suction device means is unblocked.

30. Apparatus according to claim 28, wherein said slide valve means is spring biased in a direction whereby said suction device means is blocked.

31. Apparatus according to claim 28, comprising actuating element means engageable with the said slide valve means, said actuating element means being capable of reversibly moving said slide valve means into a position whereby said suction device means is unblocked.

32. Apparatus according to claim 31, wherein said actuating element means projects out of said spinning unit for controlling said slide valve means from outside said spinning unit.

* * * * *